US006286518B1

(12) United States Patent
Laporte

(10) Patent No.: US 6,286,518 B1
(45) Date of Patent: Sep. 11, 2001

(54) DEVICE FOR APPLYING A PRODUCT TO THE HAIR, PARTICULARLY A DYE PRODUCT

(76) Inventor: Michel Laporte, 45 rue du Prè, 39200 Saint Claude (FR)

( * ) Notice: Subject to any disclaimer, the term of this patent is extended or adjusted under 35 U.S.C. 154(b) by 0 days.

(21) Appl. No.: 09/387,096

(22) Filed: Aug. 31, 1999

(30) Foreign Application Priority Data

Sep. 1, 1998 (FR) ..... 98 11052

(51) Int. Cl.[7] ..... A45D 24/22
(52) U.S. Cl. ..... 132/116; 132/115; 132/112
(58) Field of Search ..... 132/116, 115, 132/114, 113, 112

(56) References Cited

U.S. PATENT DOCUMENTS

| | | | | |
|---|---|---|---|---|
| 3,066,683 | * | 12/1962 | Pace | 132/114 |
| 3,520,311 | * | 7/1970 | Iesersek et al. | 132/116 |
| 3,960,160 | * | 6/1976 | Hogan | 132/112 |
| 4,592,376 | * | 6/1986 | Sigmund et al. | 132/112 |
| 4,867,183 | * | 9/1989 | Busch et al. | 132/110 |
| 5,638,608 | * | 6/1997 | Dorber | 34/283 |
| 5,803,093 | * | 9/1998 | Romano | 132/116 |
| 5,909,737 | * | 6/1999 | Ricco | 132/116 |

FOREIGN PATENT DOCUMENTS

879577 * 10/1961 (GB) ..... 132/116

* cited by examiner

*Primary Examiner*—John J. Wilson
*Assistant Examiner*—Robyn Doan
(74) *Attorney, Agent, or Firm*—Cantor Colburn LLP

(57) ABSTRACT

This device comprises a reservoir and a dispensing head, equipped with at least one row of application teeth, this head being connected to the reservoir by at least one channel for conveying the product to the base of the teeth. According to the invention, the head comprises at least one row of retention teeth extending along each row of application teeth and located at a distance from the latter, these teeth being shorter than the teeth; the space between one row of application teeth and an adjacent row of retention teeth, and the spaces between the teeth in these two rows, are such that they permit the product to be retained in them so that said space located between one row of application teeth and an adjacent row of retention teeth forms an intermediate product reservoir capable of receiving and temporarily retaining this product.

7 Claims, 1 Drawing Sheet

DEVICE FOR APPLYING A PRODUCT TO THE HAIR, PARTICULARLY A DYE PRODUCT

The present invention relates to a device for applying a more or less viscous product to the hair, particularly a dye product.

BACKGROUND OF THE INVENTION

Currently, hair dye products are applied to the hair using brushes. This conventional procedure has the drawback that it places the dye product in contact with the scalp, which may give rise to certain skin reactions, particularly allergic reactions.

Moreover, the production of special dye effects, for example on individual locks of hair, is difficult to achieve using the current technique without appropriate application devices.

DESCRIPTION OF THE PRIOR ART

There is a device for applying a product to the hair, comprising a product reservoir and an application head equipped with teeth. The reservoir has flexible walls and the head comprises channels which open out in this reservoir on the one hand and between the teeth on the other. The teeth may thus be supplied with product when pressure is exerted on the reservoir and allow this product to be distributed over the hair as it passes between them.

Devices of this type do not, however, always give satisfaction in practice. It is actually difficult to exert a substantially constant pressure on the reservoir with a view to controlling the emission of the appropriate quantity of product as it is applied to the hair. The irregular emission of product gives rise to unexpected runs and thus causes this product to come into contact with the scalp. These runs also give rise to a random distribution of product over the hair, making it impossible to obtain the aforesaid dye effects, particularly on individual locks of hair.

SUMMARY OF THE INVENTION

The present invention aims to remedy all these drawbacks.

The device it relates to comprises, in a manner known per se, a reservoir containing the product to be applied and a head for dispensing this product, equipped with at least one row of application teeth, this head being connected to the reservoir by at least one channel opening out in the reservoir on the one hand and near the base of the teeth on the other to allow the product to flow from this reservoir toward this base of the teeth.

According to the invention, the head comprises at least one row of teeth, hereinafter called "retention teeth", extending along each row of application teeth and located at a distance from the latter, these retention teeth being shorter than the application teeth; the space between one row of application teeth and an adjacent row of retention teeth, and the spaces between the teeth in these two rows, are such that it permit [sic] the hair to pass between the teeth of these rows but such that they allow the product to be retained in them so that said space located between one row of application teeth and an adjacent row of retention teeth forms an intermediate product reservoir capable of receiving and temporarily retaining this product.

This reservoir, at the level at which the channel or channels for conveying the product opens or open out, is located at the base of the application teeth and allows the hair to pass through it so that the latter can be loaded with product. This intermediate reservoir may be supplied periodically with product according to requirements so that it allows regulation and monitoring of the emission of product and thus the uniform application of the latter over the hair.

Thus, by virtue of the invention, the product is at no time placed in contact with the scalp and there is no risk of such contact occurring.

The channel or channels for conveying the product may open out between the teeth of one or other of the rows but, preferably, open out between two adjacent rows of application and retention teeth.

The device according to the invention may be a single-use device and have application teeth having a shape which is adapted to the viscosity of the product it is specifically intended to apply. Thus, in the case of a product having a relatively high viscosity, i.e. having a cream consistency, each application tooth has a base of cylindrical shape extending substantially as far as the top of the retention teeth whilst each of the latter has a substantially conical shape. In the case of a product having a medium or low viscosity, i.e. having, respectively, a gel or oil consistency, each application tooth has an oval-shaped section extending substantially as far as the top of the retention teeth whilst each of the latter has a substantially conical shape.

These arrangements have been found to allow the hair to be fully impregnated with product, depending on the viscosity of the latter, without the retention teeth forming an obstacle to the passage of the hair over them.

At the top, the application teeth may have a conical shape or the shape of a shell.

According to a preferred embodiment of the invention, the head comprises two lateral rows of application teeth and a central row of retention teeth and also a plurality of channels for conveying the product which open out between two adjacent rows.

BRIEF DESCRIPTION OF THE DRAWINGS

In order to understand the invention properly, it is again described below with reference to the appended diagrammatic drawing which, by way of non-limiting example, shows a preferred embodiment of the device to which it relates.

FIGS. 2 to 4 show, from different angles, a device 1 for applying a more or less viscous product to the hair, particularly a dye product.

DESCRIPTION OF THE PREFERRED EMBODIMENT

The device 1 comprises a reservoir 2 for containing the product and a head 3 for applying this product to the hair.

In the example shown, the reservoir 2 has flexible lateral walls to allow the product to be expelled by means of pressure on these walls. This reservoir 2 and the head 3 may be produced from synthetic material and this head 3 may be mounted on the reservoir 2 by means of screwing or snap-fitting of the head over a neck made in the top of the reservoir 2.

Figure 1:
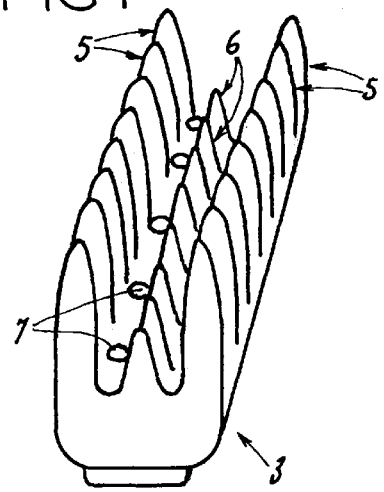
FIG. 1 is a perspective view of the dispensing head it comprises.
Figure 3:
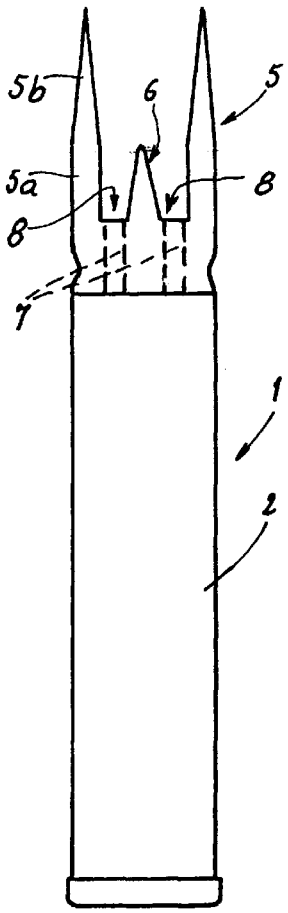
FIG. 3 is a profile view.
Figure 4:
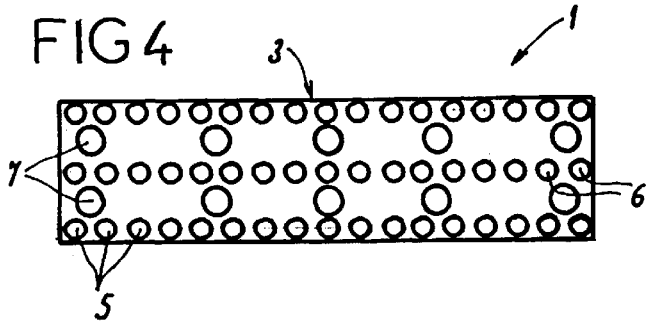
FIG. 4 is a top view.

As FIGS. 1, 3 and 4 show more particularly, the head 3 comprises three rows of teeth 5, 6 and channels 7 for conveying the product from the reservoir toward the base of these teeth 5, 6.

Figure 2:
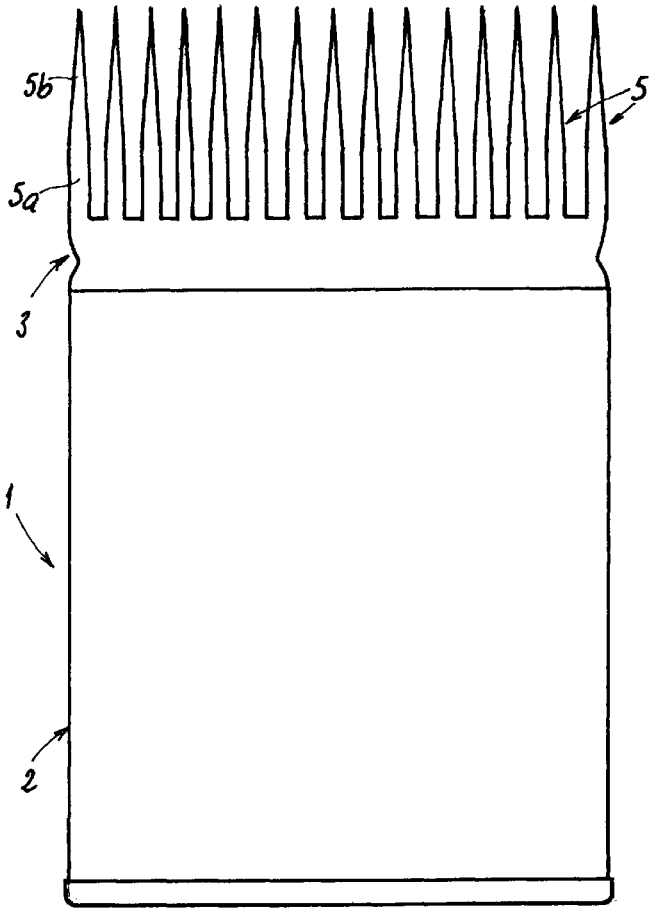
FIG. 2 is a side view of the device.

The two lateral rows of teeth 5 are used for applying the product to the hair. Each tooth 5 of these rows has a base 5*a* of cylindrical shape, extending as far as the top of the teeth 6 of the central row, and a top 5*b* which may have either a shell shape, as shown in FIG. 1, or a conical, tapered shape as shown in FIGS. 2 to 4.

The central row of teeth 6 extends along each row of teeth 5, being located at a distance from the latter, and is used for retaining product in the space 8 delimited by the rows of teeth 5 and 6.

The teeth 6 are shorter than the teeth 5 and have a substantially conical shape.

The spaces 8 and the spaces between the teeth 5, 6 of each row are such that it permit [sic] the hair to pass between the teeth 5, 6, but such that they allow the product to be retained in them, depending on the viscosity of the latter.

The channels 7 open out step by step in the reservoir 2 on the one hand and in the base of the spaces 8 on the other to allow the teeth 5, 6 to be supplied with product.

The shapes, sizes or spacing of the head 3, the teeth 5, 6, channels 7 and spaces 8 may vary more or less as a function of the viscosity of the product to be applied in order to ensure optimum retention and application of the product.

Thus, in the case of a product having a relatively high viscosity, i.e. having a cream consistency, such as the product marketed as "MAJIREL" by L'OREAL, the shapes, sizes or spacing of the head 3, teeth 5, 6, channels 7 and spaces 8 are preferably as follows:

head 3: length 40 mm; width 10 mm;

teeth 5: height 10 mm; diameter 1 mm, part 5*a* 7 mm in height, part 5*b* of conical shape;

total space between the rows of teeth 5: 8 mm;

total number of teeth 5: 20 to 22;

channels 7: 2 mm in diameter; five in number in each space 8, i.e. 10 in total;

teeth 6: 6 mm in height; base 2 mm in diameter;

width of each space 8: 3 mm.

In the case of a product having a medium viscosity, i.e. having a gel consistency, such as the product marketed as "CRESCENDO" by L'OREAL, the shapes, dimensions or spacing of the head 3, teeth 5, 6, channels 7 and spaces 8 are preferably as follows:

head 3: length 40 mm; width 10 mm;

teeth 5: height 10 mm; oval section 1.5 mm in length and 1 mm in width; part 5*a* 7 mm in height, part 5*b* of tapered shape;

total space between the rows of teeth 5: 7 mm;

total number of teeth 5: 22 to 24;

channels 7: 1.5 mm in diameter; six in number in each space 8, i.e. 12 in total;

teeth 6: 6 mm in height; base 2 mm in diameter;

width of each space 8: 2.5 mm.

In the case of a product having a lower viscosity, i.e. having an oil consistency, such as the product marketed as "RENOVATIVE" by L'OREAL, the shapes, sizes or spacing of the head 3, teeth 5, 6, channels 7 and spaces 8 are preferably as follows:

head 3: length 40 mm; width 10 mm;

teeth 5: height 10 mm; oval section 2 mm in length and 1 mm in width; part 5*a* 7 mm in height, part 5*b* of tapered shape;

total space between the rows of teeth 5: 6 mm;

total number of teeth 5: 24 to 26;

channels 7: 1.2 mm in diameter; seven in number in each space 8, i.e. 14 in total;

teeth 6: 6 mm in height; base 2 mm in diameter;

width of each space 8: 2 mm.

The invention thus provides a device for applying a more or less viscous product to the hair, particularly a dye product, which remedies the drawbacks of similar devices of the prior art. The intermediate reservoirs formed by the spaces 8 allow regulation and monitoring of the emission of product and thus uniform application of the latter over the hair.

Obviously, the invention is not limited to the embodiment described above by way of example but, on the contrary, includes all variant embodiments thereof. Thus, the product may be conveyed in a manner other than by deforming the reservoir 2, particularly by means of a piston system.

What is claimed is:

1. A device for applying a more or less viscous product to hair, particularly a dye product, comprising:

a reservoir for the product to be applied; and a head for dispensing the product connected to the reservoir by at least one channel opening out in the reservoir on the one hand and near the base of the teeth on the other to allow the product to flow from the reservoir toward the base of the teeth;

wherein the head comprises a first row of application teeth, a second row of application teeth positioned opposite the first row of application teeth, and a row of retention teeth located between the first and second rows of application teeth, the retention teeth being shorter than the application teeth; and wherein spaces between the rows of application teeth and the row of retention teeth, and spaces between the teeth in these rows, are such that the hair is permitted to pass between the teeth of these rows but such that they allow the product to be retained so that said spaces located between the rows of application teeth and the row of retention teeth form an intermediate product reservoir capable of receiving and temporarily retaining the product.

2. The device as claimed in claim 1, wherein the channel or channels for conveying the product open out between two adjacent rows of application and retention teeth.

3. The device as claimed in claim 1, which is a single-use device and which has application teeth having a shape which is adapted to the viscosity of the product it is specifically intended to apply.

4. The device as claimed in claim 3, wherein, in the case of a product having a relatively high viscosity, i.e. having a cream consistency, each application tooth has a base of cylindrical shape extending substantially as far as the top of the retention teeth whilst each of the latter has a substantially conical shape.

5. The device as claimed in claim 3, wherein, in the case of a product having a medium or low viscosity, i.e. having, respectively, a gel or oil consistency, each application tooth has an oval-shaped section extending substantially as far as the top of the retention teeth whilst each of the latter has a substantially conical shape.

6. The device as claimed in claim 1, wherein the application teeth have a conical shape or the shape of a shell at the top.

7. The device as claimed in claim 1, wherein the head comprises a plurality of channels for conveying the product which open out between said spaces located between the rows of application teeth and the row of retention teeth.

* * * * *